US006711915B2

(12) United States Patent
Quach

(10) Patent No.: US 6,711,915 B2
(45) Date of Patent: Mar. 30, 2004

(54) ADJUSTABLE MOUNTING FOR JEWELRY

(76) Inventor: Jonathan F. Quach, 216 E. Walnut Park Dr., Philadelphia, PA (US) 19120

( * ) Notice: Subject to any disclaimer, the term of this patent is extended or adjusted under 35 U.S.C. 154(b) by 0 days.

(21) Appl. No.: 10/220,562

(22) PCT Filed: Dec. 28, 2001

(86) PCT No.: PCT/US01/50766

§ 371 (c)(1),
(2), (4) Date: Sep. 3, 2002

(87) PCT Pub. No.: WO02/052973

PCT Pub. Date: Jul. 11, 2002

(65) Prior Publication Data

US 2003/0089130 A1 May 15, 2003

Related U.S. Application Data

(60) Provisional application No. 60/259,445, filed on Jan. 3, 2001.

(51) Int. Cl.[7] ..... A44C 17/02

(52) U.S. Cl. ..... 63/31; 63/15; 63/26

(58) Field of Search ..... 63/15, 26, 28, 63/31

(56) References Cited

U.S. PATENT DOCUMENTS

| | | | |
|---|---|---|---|
| 766,435 | A | 8/1904 | Fitzgerald |
| 959,340 | A | 5/1910 | Hauser |
| 2,147,740 | A | 2/1939 | Gruber |
| 2,316,225 | A | 4/1943 | De De Hoffman |
| 2,598,281 | A | 5/1952 | Meeker |
| 2,666,306 | A | 1/1954 | Wittmayer |
| 3,307,375 | A | 3/1967 | Estrin |
| 3,568,467 | A | 3/1971 | Ellison |
| 4,220,017 | A | 9/1980 | Freeman |
| 4,488,415 | A | 12/1984 | Jenkins |
| 4,742,696 | A | 5/1988 | Jenkins |
| 4,794,766 | A | 1/1989 | Schunk |
| 5,022,238 | A | 6/1991 | German |
| 5,375,434 | A | 12/1994 | Wertheimer |
| 5,682,769 | A | 11/1997 | Baker |
| 5,787,731 | A | 8/1998 | Ebara |
| 6,427,487 | B1 | 8/2002 | Morgan |

FOREIGN PATENT DOCUMENTS

| | | |
|---|---|---|
| AU | 209495 | 7/1957 |

*Primary Examiner*—J. J. Swann
*Assistant Examiner*—Thomas Ho
(74) *Attorney, Agent, or Firm*—Dann, Dorfman, Herrell and Skillman, P.C.

(57) ABSTRACT

A device (10) for mounting gemstones and decorative components on a jewelry piece (1). The mounting device (10) has a mounting stud (30) configured for supporting a gemstone (5) or other decorative component on the jewelry piece (1). A mounting base (40) is connected to the mounting stud (30) and disposed inside a cavity (28). The mounting base (40) is held in an abutting relationship with a toggling mechanism (50) that permits rotation of mounting base (40) within the cavity (28). The mounting stud (30) is adjustable to orient a gemstone (5) or decorative component in a plurality of orientations relative to the jewelry piece (1).

20 Claims, 10 Drawing Sheets

ADJUSTABLE MOUNTING FOR JEWELRY

RELATED APPLICATIONS

This application claims priority under 35 U.S.C. §119 to U.S. Provisional Application No. 60/259,445, filed Jan. 3, 2001, which is hereby incorporated herein by reference.

FIELD OF THE INVENTION

The present invention relates to jewelry and more particularly to a device for adjustably mounting gemstones and similar decorative components in a jewelry piece.

BACKGROUND

When designing pieces of jewelry, it is often desirable to provide a piece of jewelry that can be worn and displayed in a number of configurations. For example, U.S. Pat. No. 4,220,017 discloses a convertible finger ring having a gem mount which may be rotated into two positions relative to the ring band. The gem mount may be rotated relative to the ring band to provide either a pendant configuration or ring configuration.

Convertible or adjustable jewelry pieces require a high degree of craftsmanship. In particular, the jewelry piece must be crafted to support the gem mount in the desired fashion, and the fabrication of the jewelry piece must be done with sufficient care to maintain the gem mount against potential separation from the jewelry piece. Since the gem is adjustable into a number of positions, it is desirable to stabilize the gem and minimize shifting or swiveling of the gem once it is adjusted to a desired position. From a manufacturing perspective, it is desirable to have components of a jewelry mount that can be manufactured and incorporated into a variety of gem mounts, rather than components that are specific to one style of mount.

SUMMARY OF THE INVENTION

In light of the foregoing, the present invention provides a gem mount that may be readily incorporated into a piece of jewelry. The gem mount may include a rectangular hollow cartridge that is configured for attachment to a jewelry piece. The cartridge includes a mounting mechanism configured to support a gemstone or other decorative component on the outside of the cartridge. The mounting mechanism includes a base in the cartridge configured to rotate within the cartridge. A mounting stud extends from the base and projects out of the cartridge through a slot or opening cut into a side of the cartridge. The base and mounting stud are displaceable to permit the gemstone or decorative component to be displayed in different positions on the jewelry piece.

The gem mount may be operable to convert a jewelry piece from one configuration, such as a ring, to another configuration, such as a pendant. In particular, the gem mount may permit toggling of a gemstone or decorative component between an upward facing orientation and a forward facing orientation relative to the mount. In the upward facing orientation, the gemstone's position may be considered appropriate for a ring. In the forward facing orientation, the gemstone's position may be considered appropriate for a pendant. The gem mount may also permit toggling of a gemstone or decorative component to a downward facing orientation relative to the mount. In the downward facing orientation, the gemstone's position may be considered appropriate for a pendant. The gem mount may further be operable to permit horizontal rotation of a decorative component.

The mounting mechanism may be enclosed within a cartridge that is attached to a jewelry piece. The interior of the cartridge forms a cavity receiving the mounting mechanism. Alternatively, the mounting mechanism may be enclosed within a cavity formed in a jewelry piece. In either case, the mounting mechanism cooperates with a toggling mechanism to control the position of the gemstone or decorative component relative to the gem mount. The toggling mechanism may include a toggle block and a compression spring that imposes a bias force on the toggle block. The bias force displaces the toggle block into an abutting relationship with the base, and the base, in turn, bears against an interior surface in the cavity. The engagement between the toggle block and base controls the rotational displacement of the base, so that the chosen position of the gemstone or decorative component remains stable.

The base, toggle block and spring may be retained in the cavity by a cover plate that attaches over the cavity. The cover plate may be attached over the cavity by a pair of screws that extend through the cover plate. Where a cartridge is used, the exterior components of the gem mount may interconnect so as to form a smooth continuous exterior on the cartridge suitable for insertion into a jewelry piece. The present invention may be practiced in multiple embodiments that share common components. More specifically, the toggle block, spring, cover plate and screws have the same configurations in each embodiment and may be mass produced for use in any of the different embodiments.

DESCRIPTION OF THE DRAWINGS

The foregoing summary as well as the following description will be better understood when read in conjunction with the figures in which.

DETAILED DESCRIPTION OF THE PREFERRED EMBODIMENT

Figure 1:
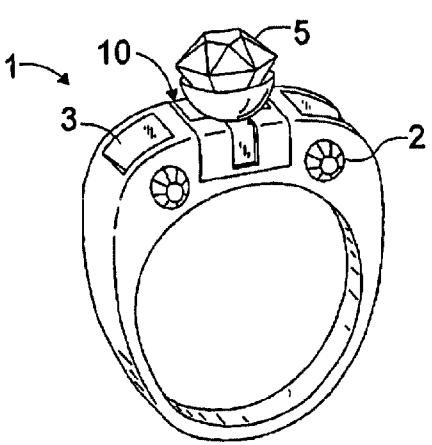
FIG. 1 is a perspective view of a jewelry piece having an adjustable jewelry mount in accordance with the present invention, said mount being adjusted to display a gemstone in a ring configuration.
Figure 2:
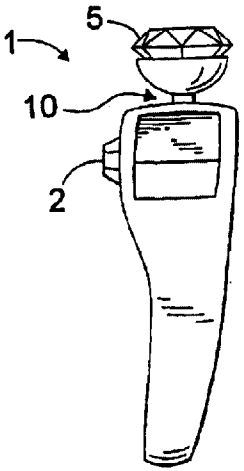
FIG. 2 is a side elevation view of the jewelry piece in FIG. 1.
Figure 3:
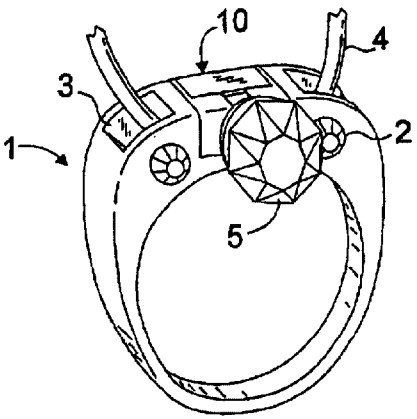
FIG. 3 is a perspective view of the jewelry piece in FIG. 1 with the jewelry mount adjusted to display a gemstone in a pendant configuration on a chain.
Figure 4:
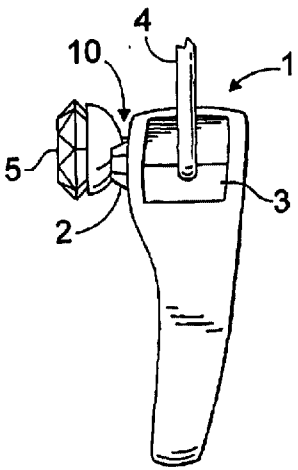
FIG. 4 is a side elevation view of the jewelry piece in FIG. 3.

Referring to FIGS. 1–16B in general, and to FIGS. 1–4 specifically, a jewelry piece 1 is shown having a gem mount 10 and a pair of adornments 2 disposed on either side of the gem mount. A pair of opposing symmetrical passages 3 are disposed through the jewelry piece 1 on either side of the gem mount 10. The jewelry piece 1 is configured to be worn or displayed as a ring, as shown in FIGS. 1–2. The jewelry piece 1 is also configured to be suspended on a chain 4 so that it can be worn or displayed as a pendant, as shown in FIGS. 3–4.

The mount 10 is operable to position a decorative component, commemorative component or the like in different orientations so that the jewelry piece 1 can be converted between a ring and a pendant. In FIGS. 1–4, the mount 10 is shown supporting a gemstone 5. The gem mount 10 is adjustable to position the gemstone in an upward facing orientation. In this configuration, the jewelry piece 1 may be worn or displayed as a ring, as shown in FIGS. 1–2. The gem mount 10 is also configured to display the gemstone 5 in a forward facing orientation. In this configuration, the jewelry piece 1 may be worn or displayed as a pendant.

Figure 5B:
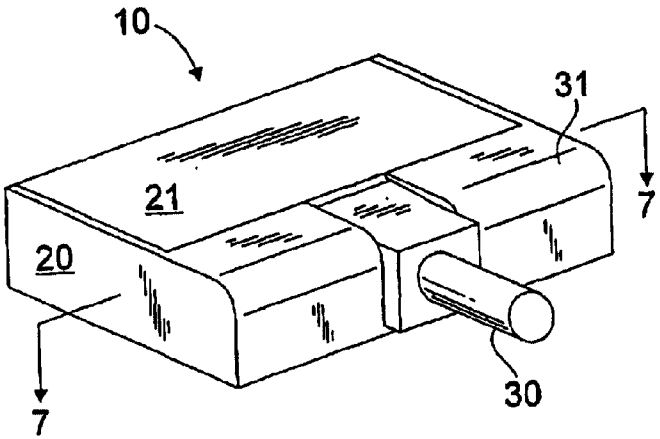
FIG. 5B is a perspective view of the jewelry mount in FIG. 5A, showing the mounting stud positioned in a forward facing orientation relative to the mount.
Figure 5A:
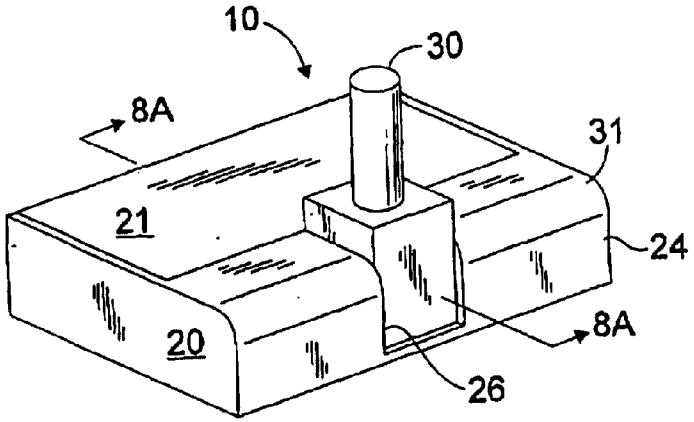
FIG. 5A is a perspective view of the adjustable jewelry mount in FIG. 1, showing a cartridge and a mounting stud positioned in an upward facing orientation relative to the mount.

Gem mount 10 may be manufactured as a cartridge that may be incorporated into the body of a jewelry piece 1. Referring to FIGS. 5A–5B, gem mount 10 may include a hollow cartridge 20 having a cavity 28 that contains a mounting stud 30. The mounting stud 30 may be pivoted to an upward facing position, as shown in FIG. 5A, to display a gemstone in an upward facing orientation. The mounting stud 30 may also be pivoted to a forward facing position, as shown in FIG. 5B, to display a gemstone in an forward facing orientation.

Figure 6:
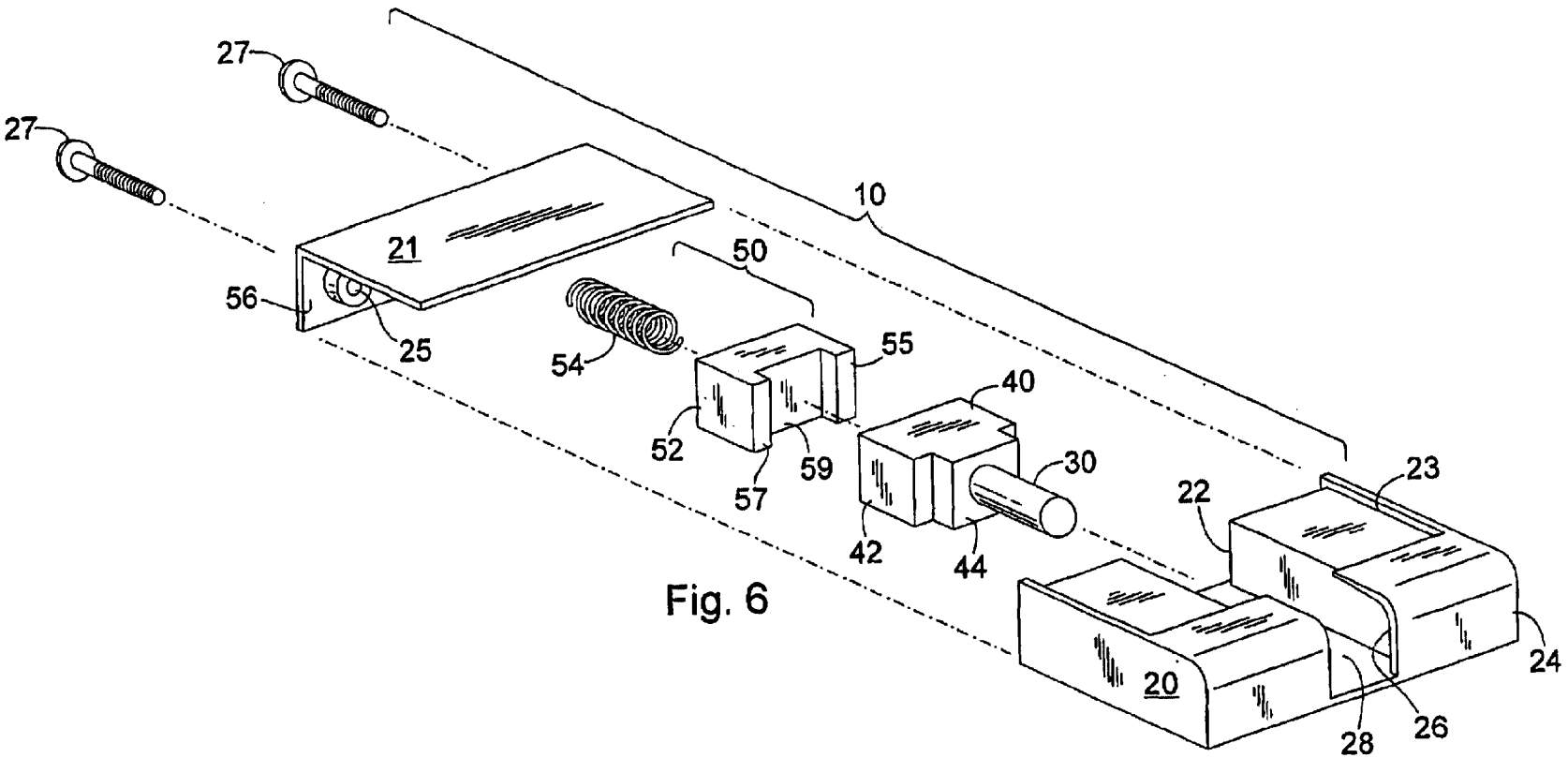
FIG. 6 is an exploded perspective view of the jewelry mount in FIG. 5B.

Referring now to FIGS. 5A–6, the gem mount 10 will be described in greater detail. Gem mount 10 may comprise a generally rectangular cartridge 20 having an open rearward end 22 and a generally closed forward end 24. An elongated slot 26 extends through the generally closed forward end 24. Cartridge 20 is partially hollowed so as to form a generally rectangular cavity 28 in the interior of the cartridge, as shown in FIG. 6. The cavity 28 forms a continuous opening with the elongated slot 26 in the cartridge wall.

Figure 7:
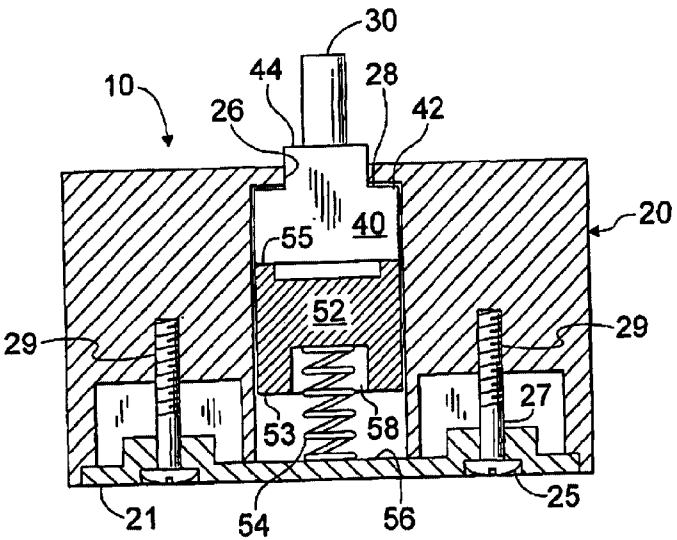
FIG. 7 is a cross-sectional view of the jewelry mount in FIG. 5B.

The hollow interior of cartridge 20 may be enclosed with a cover plate 21, as shown in FIGS. 5A and 5B. Cover plate may be attached to cartridge 20 using any suitable connection, such as a weld joint or a press fit connection. Referring now to FIGS. 6–7, the cover plate 21 is shown screwed to the cartridge 20. The cover plate 21 has a pair of orifices 25 adapted to receive a pair of screws 27. A pair of threaded screw holes 29 are disposed in a solid interior portion of cartridge 20 and are configured to cooperate with screws 27 to secure the cover plate 21 to the cartridge. As shown in FIG. 6, the cartridge 20 comprises a shallow recess 23 that extends along the rearward end and top side of the cartridge. The recess 23 is adapted to receive the cover plate 21. The orifices 25 in the cover plate 21 are configured for axial alignment with the screw holes 29 in the cartridge when cover plate 21 is placed over the recess 23. In this way, the orifices 25 permit the screws 27 to cooperate with the screw holes 29. Preferably, the orifices 25 are countersunk on the exterior of the cover plate 21, such that the heads of the screws 27 are flush with the exterior surface of the cover plate when the cover plate is secured to the cartridge 20.

A generally rectangular symmetrical mounting base 40 is disposed in the cavity 28 in cartridge 20. The mounting base 40 comprises an enlarged body portion 42 and a narrow neck portion 44 extending from the body portion, as shown in FIG. 6. The cavity 28 is adapted to receive the body portion 42 and has a width slightly larger than the width of the body portion. A clearance space between the body portion 42 and walls of the cavity 28 allows the mounting base 40 to be pivoted or rotated inside the cavity. The neck portion 44 is preferably centered on the body portion 42 and aligns with the slot 26. The width of the neck portion 44 is slightly less than the width of the slot 26. As such, the neck portion 44 may fit within the slot 26 and travel along the slot as the body portion 42 is rotated in the cavity 28.

A mounting pin or stud 30 extends longitudinally from the mounting base 40. More specifically, the mounting stud 30 extends from the neck portion 44 of mounting base 40 and projects through the slot 26 to the exterior of the cartridge 20. The mounting stud 30 is configured for securely holding a gemstone or decorative component 5 on gem mount 10 and may have any shape or configuration suitable for such mounting. In FIGS. 5A, 5B and 6, the mounting stud is shown with a cylindrical shape. The mounting stud 30 is pivotable with the mounting base 40 to display a gem stone or decorative component 5 in different orientations.

A toggling mechanism 50 is contained in the cavity 28 and engages the mounting base 40 to control rotational displacement of the mounting base and mounting stud 30 as the gem stone 5 is adjusted between different positions. In FIGS. 6–7, the toggling mechanism 50 is shown comprising a toggle block 52 and a compression spring 54 disposed between the toggle block 52 and a rearward interior wall 56 in the cartridge. Referring to FIG. 6, the cover plate 21 forms the rearward interior wall 56 which bears against the spring 54.

Figure 8A:
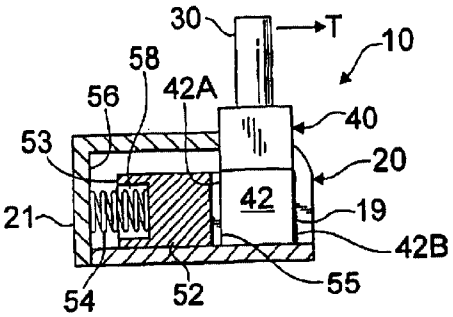
FIG. 8A is a cross-sectional view of the jewelry mount in FIG. 5A, showing a mounting base and mounting stud adjusted in an upward facing orientation relative to the mount.
Figure 8B:
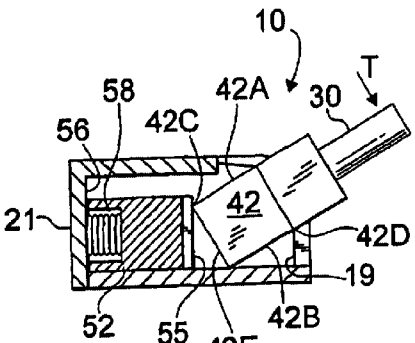
FIG. 8B is a cross-sectional view of the jewelry mount in FIG. 8A, showing the mounting base and mounting stud positioned in an intermediate position.
Figure 8C:
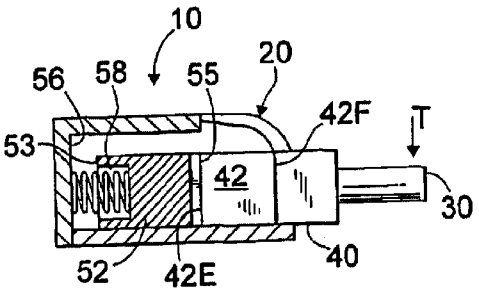
FIG. 8C is a cross-sectional view of the jewelry mount in FIG. 8A, showing the mounting base and mounting stud adjusted in a forward facing orientation relative to the mount.

Referring now to FIGS. 7–8C, the toggle block 52 comprises a rearward end 53 that faces the rearward interior wall 56 and a forward end 55 that engages the mounting base 40. The rearward end 53 of the toggle block 52 comprises a hollow cylindrical bore 58 adapted to receive a forward end of the spring 54. When the spring 54 is inserted into the bore 58 and the cover plate 21 is secured to the cartridge 20, the rearward interior wall 56 on the cover plate bears against a rearward end of the spring 54 such that the spring is compressed between the rearward interior wall 56 and the toggle block 52. Since the cover plate 21 is secured to the cartridge 20, the rearward interior wall 56 is stationary relative to the cartridge. The toggle block 52 is slidably displaceable in the cavity 28. As a result, the compressed spring 54 exerts a forward biasing force on the toggle block 52 which displaces the toggle block into engagement with the mounting base 40 and maintains this engagement during movement of the mounting base. In particular, the spring 54 biases the toggle block 52 forwardly and urges the toggle block into an abutting relationship with the body portion 42 of mounting base 40, as shown in FIG. 8A.

Referring now to FIGS. 8A, 8B and 8C, the interaction between the toggle block 52 and mounting base 40 will be described in greater detail. FIG. 8A shows a gem mount 10 with the mounting stud 30 disposed in an upward position. More specifically, the mounting stud 30 is configured to display a gemstone in an upward facing orientation. The toggle block 52 is maintained in an abutting relationship with the body portion 42 of mounting base 40 by the bias of the spring 54, which is compressed between the rear interior face 56 of the cartridge and the toggle block 52. In FIG. 8A, the forward face 55 of the toggle block 52 engages a first face 42A on the body portion of the mounting base 40. A second face 42B on the body portion 42 abuts an interior face 19 of the cartridge 20 at the cartridge's forward end. As such, the body portion 42 of mounting base 40 is compressed and held in a stable position against the interior face 19 by the bias of the spring 54. More specifically, the abutting relationship between the toggle block 52 and first face 42A, and the abutting relationship between the second face 42B and interior face 19, maintain the mounting base in a stable position that resists rotational displacement.

As stated earlier, the cavity 28 is configured to permit rotation of the mounting base 40. Mounting base 40 may be rotated by applying a force on the gemstone or the mounting stud 30 in a direction transverse to the longitudinal axis of the mounting stud, as represented by the arrow marked "T" in FIG. 8A. FIG. 8B shows the mounting base 40 in a rotated position relative to the position in FIG. 8A. As the mounting base 40 is rotated from the position in FIG. 8A to the position in FIG. 8B, the body portion 42 rotates such that a corner edge 42C rotates into engagement with the toggle block 52, and corner edge 42D rotates into engagement with interior forward end 19. The toggle block 52 is maintained in an abutting relationship with the mounting base 40 during rotation of the base by the bias of the spring 54, which remains compressed between the rearward end 56 and the mounting base 40. As the base 40 is rotated, the corner edges 42C, 42D on the body portion 42 slide along the interior surfaces of the cartridge. The surface of the toggle block 52 and interior surfaces of the cartridge are relatively smooth, such that corner edges 42C, 42D slide against the interior surfaces With little frictional resistance. Since the interior surfaces offer little frictional resistance on the body portion 42, the body portion is easily rotatable, and the position of the mounting base 40 is relatively unstable under the bias of spring 54 until the forward bias of the spring urges rotation of the body portion so that the sides of the body portion 42 engage surfaces on the toggle block and in the cartridge.

FIG. 8C shows the mounting base 40 fully rotated into a forward position. More specifically, the mounting stud 30 is configured to display a gemstone in a forward facing orientation. The toggle block 52 is maintained in an abutting relationship with the body portion 42 of mounting base 40, such that the forward face 55 of the toggle block engages a third face 42E on the body portion of the mounting base. A fourth face 42F on the body portion 42 abuts the interior face 19 of the cartridge 20 at the cartridge's forward end. Since the sides 42E, 42F engage the toggle block 52 and interior face 19, respectively, the mounting base 40 is again oriented in a relatively stable position that resists rotational displacement.

Based on the foregoing, the bias force exerted by the spring 54 on the toggle block 52 and body portion 42 of mounting base 40 urges the mounting stud 30 into either the upward facing orientation shown in FIG. 8A or the forward facing orientation shown in FIG. 8C. When the rotational force T is released from the mounting stud 30, the forward bias of the spring 54 urges displacement of the body portion 42 to either the upward facing orientation or forward facing orientation. Preferably, the mounting base 40 is configured so that the orientation of the base is relatively unstable and does not remain in the intermediate position shown in FIG. 8B. In particular, the corner edges 42C,42D of mounting base 40 are preferably configured to slide against the toggle block and interior of the cartridge with minimal frictional resistance. In this way, the bias of the spring 54 is sufficient to overcome the minimal frictional resistance between the corner edges of the body portion 42 and the cartridge interior, thereby urging the body portion to one of the more stable positions shown in FIGS. 8A and 8C.

Referring again to FIGS. 5A and 5B, the cartridge 20 is shown having an upper corner edge 31 on the forward end 24. When a gemstone is mounted on mounting stud 30, the underside of the gemstone must clear the upper corner edge 31 in order to move between the upper facing position and forward facing position. More specifically, a clearance space must be provided between the underside of the gemstone and the upper corner edge of the cartridge to permit the gemstone to be rotated. To provide such clearance, the gemstone may be mounted on the stud 30 at a distance above the surface of the cartridge 20. One skilled in the art of jewelry manufacturing will acknowledge that the height of the gemstone above the mount affects both the visual appearance of the jewelry piece and the structural integrity of the mount. A gemstone that is mounted relatively high above the mount may have an odd appearance. In addition, a gemstone mounted high above the mount may have a greater risk of being separated from the mount than a lower set gemstone. Therefore, it is desirable to minimize the clearance space between the gemstone and the mount. The amount of clearance space required between the cartridge 20 and the underside of a gemstone is largely a function of the shape of the corner edge 31 on the cartridge. A greater amount of clearance is required for a cartridge having a square shaped upper corner than for a cartridge having a rounded or beveled upper corner. As a result, the cartridge 20 preferably includes a rounded corner edge 31, as shown in FIGS. 5A and 5B. The rounded edge 31 provides adequate clearance space between the underside of a gemstone and the exterior of the cartridge 20 to allow rotation of the gemstone between the upward facing orientation shown in FIG. 5A and the forward facing orientation shown in FIG. 5B.

The exterior surfaces of the cartridge 20 are preferably continuous to facilitate proper insertion and connection to a jewelry piece 1. In particular, the cover plate 21 is preferably configured to substantially conform with recess 23 on the cartridge 20 such that exterior surfaces of the cover plate are mounted flush with the exterior surfaces of the cartridge. As stated earlier, the screw holes 29 on the cover plate 21 are preferably countersunk such that the heads on screws 27 are flush with the exterior of the cover plate.

Interior components in the cartridge 20 may be partially visible through the longitudinal slot 26. In particular, the mounting base 40 and toggle block 52 may be partially visible through the slot 26 when the mount 10 is viewed looking at the front end 24 or looking down on the top end. As a result, visible interior components are preferably manufactured with a luster consistent with the rest of the jewelry piece 1, so that the overall attractiveness of the jewelry piece is not adversely affected by the visible interior components.

The forward face 55 of the toggle block 52 may be visible through the slot 26 when the mounting base 40 is rotated to an intermediate position, such as that shown in FIG. 8B. Since corner edges on the body portion 42 of the mounting base 40 engage the forward face 55 of the toggle block 52, the metallic luster or appearance of the forward face may become scuffed or worn over time. Therefore, the forward face 55 of toggle block 52 preferably includes a projecting portion that contacts the mounting base 40 and an inset or recessed portion that does not contact the mounting base. Referring to FIG. 6, the toggle block 52 is shown with a recessed portion 59. The recessed portion 59 is centered on the forward face 55 and axially aligned with the slot 26 such that the recessed portion is visible through the slot. The recessed portion 59 is centered between two projecting areas 57 which engage the body portion 42 of mounting base 40. Preferably, the recessed portion 59 has a width slightly greater than the width of the slot 26 such that only the recessed portion is visible through the slot, and the projecting areas 57 are not visible through the slot. As stated earlier, the recessed portion 59 preferably has a luster consistent with the exterior of the jewelry piece 1 so that it does not disrupt or detract from the overall appearance of the jewelry piece.

Thus far, the gem mount 10 has been described as a mount that permits adjustment of a gemstone or decorative component between an upward facing orientation and a forward facing orientation relative to the mount. It may be desirable, however, to provide a mount that permits adjustment of a gemstone or decorative component in more than two positions. Referring now to FIGS. 9A–12C, a second embodiment of the present invention is shown, featuring a gem mount 110 that is adjustable in three positions on a jewelry piece 101. The gem mount 110 operates in the same general manner and comprises many of the same elements as those described for the first embodiment previously discussed. For purposes of this description, elements on jewelry piece 101 that correspond to similar elements in the first embodiment are referenced with the same number plus one hundred.

The gem mount 110 is mounted on a jewelry piece 101 having a pair of adornments 102 and a pair of opposing passages 103 similar to the first embodiment. The passages 103 are located on a thin band portion 109 of the jewelry piece 101. The jewelry piece may be worn or displayed as a ring. Alternatively, the jewelry piece 101 is configured to be suspended on a chain 104 so that it can be worn or displayed as a pendant.

Figure 9C:
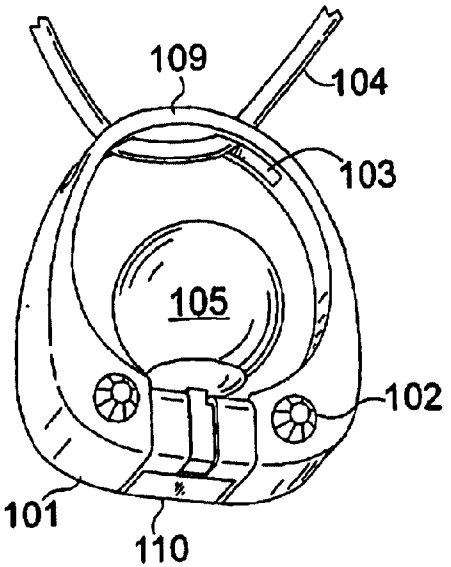
FIG. 9C is a perspective view of the jewelry piece of FIG. 9B with the jewelry mount adjusted to display a gemstone in a second pendant configuration.
Figure 9B:
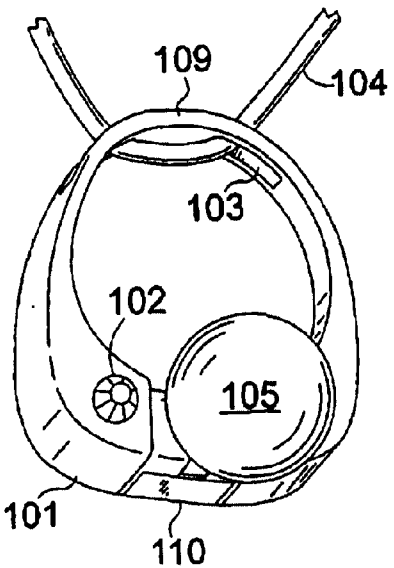
FIG. 9B is a perspective view of the jewelry piece of FIG. 9A with the jewelry mount adjusted to display a gemstone in a first pendant configuration.
Figure 9A:
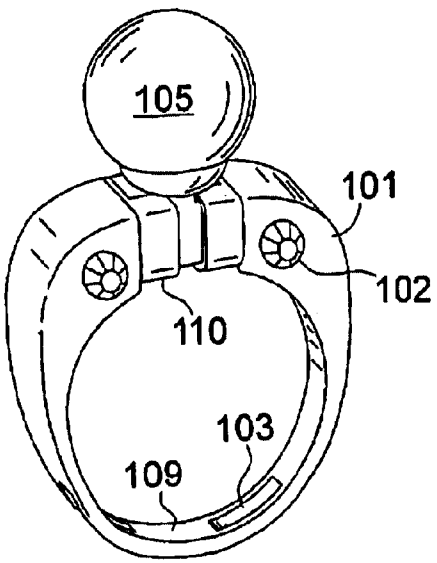
FIG. 9A is a perspective view of a jewelry piece having an adjustable jewelry mount in accordance with a second embodiment of the present invention, said jewelry mount being adjusted to display a gemstone in a ring configuration.

The mount 110 is configured to position a decorative component, commemorative component, or the like in three different orientations. In FIG. 9A, the mount 110 is shown configured for displaying a gemstone 105 in an upward facing orientation on the jewelry piece 101. As such, the jewelry piece 101 may be worn or displayed as a ring. In FIGS. 9B and 9C, the mount 110 is shown configured for displaying the gemstone 105 in a pendant configuration. In particular, the mount 110 is configured to display the gemstone 105 in a forward facing orientation in FIG. 9B. In FIG. 9C, the mount 110 is configured to display the gemstone 105 in a downward orientation relative to the mount (or inward orientation relative to the jewelry piece 101).

Figure 10B:
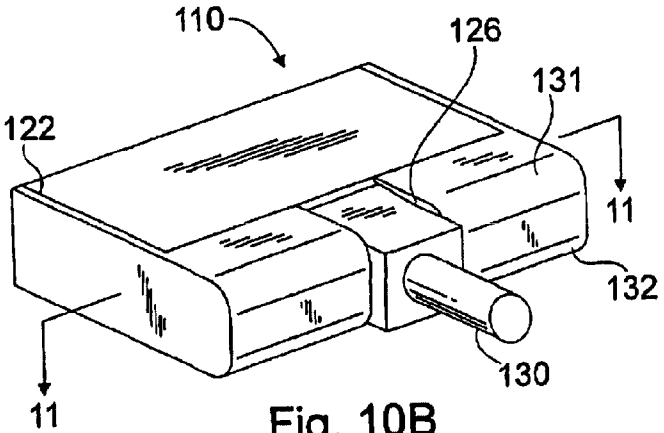
FIG. 10B is a perspective view of the jewelry mount in FIG. 10A, showing the mounting stud adjusted in a forward facing orientation relative to the mount.
Figure 10C:
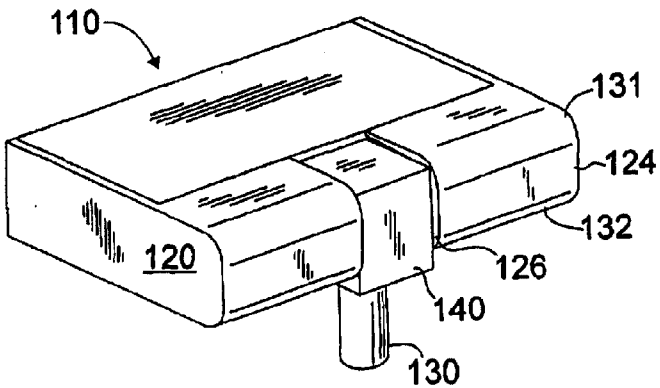
FIG. 10C is a perspective view of the jewelry mount in FIG. 10A, showing the mounting stud adjusted in a downward facing orientation relative to the mount.
Figure 10A:
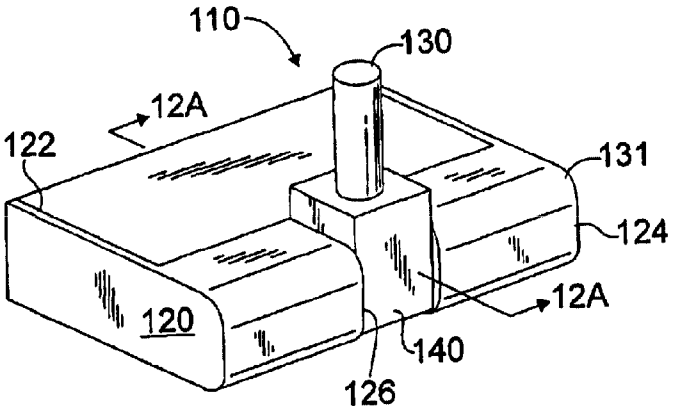
FIG. 10A is a perspective view of the jewelry mount as used in FIG. 9A, showing a cartridge and a mounting stud positioned in an upward facing orientation.

As in the first embodiment, gem mount 110 comprises a cartridge 120 that may be incorporated into the body of a jewelry piece 101. Cartridge 120 has a hollow cavity 128 that holds a mounting stud 130. The mounting stud 130 is displaceable to display a gemstone or decorative component 105 in three general orientations. Referring to FIG. 10A, the mounting stud 130 may be pivoted to an upward facing position relative to the mount 110 to display a gemstone in an upward facing orientation, as shown in FIG. 9A. Referring to FIG. 10B, the mounting stud 130 may also be pivoted to a forward facing position to display a gemstone in a forward facing orientation, as shown in FIG. 9B. Referring to FIG. 10C, the mounting stud 130 may be further pivoted to a downward facing position relative to the mount 110, to display a gemstone in an inward facing orientation, as shown in FIG. 9C.

Figure 11:
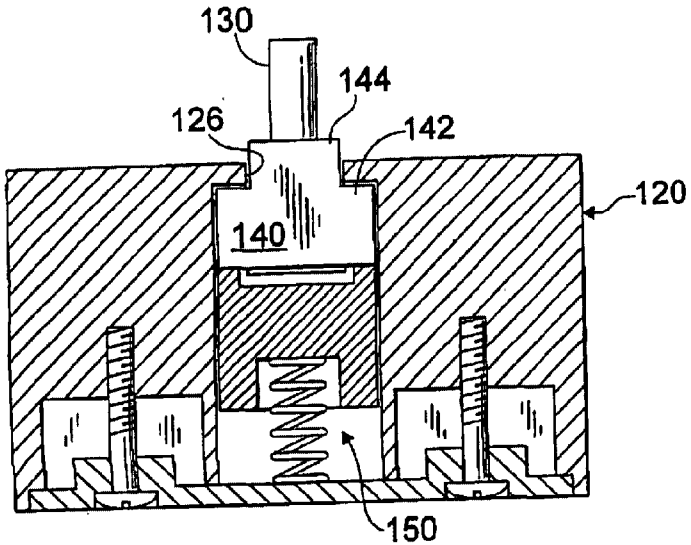
FIG. 11 is a cross-sectional view of the jewelry mount in FIG. 10B.

Referring now to FIGS. 10A–11, the cartridge 120 comprises an upper corner edge 131 and a lower corner edge 132. Corner edges 131,132 are rounded similar to the first embodiment to minimize the clearance space required between the underside of a gemstone 105 and the exterior of the cartridge 120. The cartridge 120 has an open rearward end 122 and a generally closed forward end 124. An elongated slot 126 extends through the generally closed forward end 124. More specifically, the slot 126 commences from a point on the top side on the cartridge 120 and extends through the forward end 124 to a point on the bottom side of the cartridge. A generally rectangular symmetrical mounting base 140 is disposed in the cavity 128 of cartridge 120. The mounting base 140 comprises an enlarged body portion 142 and a narrow neck portion 144 extending from the body portion, as shown in FIG. 11. A mounting pin or stud 130 extends longitudinally from the mounting base 140 and projects through the slot 126 to the exterior of the cartridge 120. The mounting stud 130 is configured for securely holding a gemstone or decorative component 105 on gem mount 110 and may have any shape or configuration suitable for such mounting.

Figure 12A:
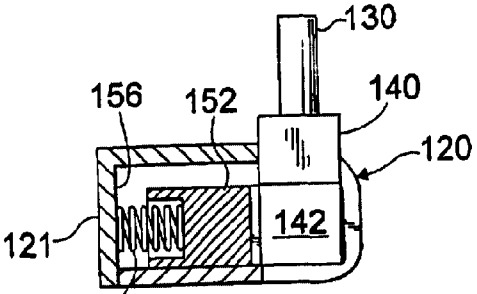
FIG. 12A is a cross-sectional view of the jewelry mount as positioned in FIG. 10A, showing a mounting base and mounting stud adjusted in an upward facing orientation relative to the mount.
Figure 12C:
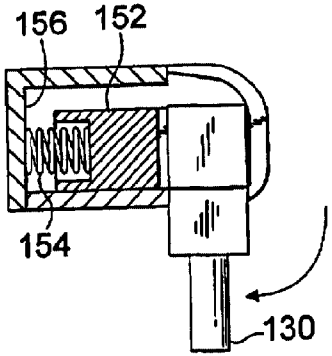
FIG. 12C is a cross-sectional view of the jewelry mount as positioned in FIG. 10C, showing the mounting base and mounting stud adjusted in a downward facing orientation relative to the mount.
Figure 12B:
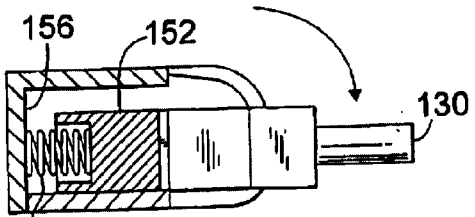
FIG. 12B is a cross-sectional view of the jewelry mount as positioned in FIG. 10B, showing the mounting base and mounting stud adjusted in a forward facing orientation relative to the mount.

A toggling mechanism 150 is contained in the cartridge 120 and engages the mounting base 140 to control rotational displacement of the mounting base and mounting stud 130 as the gemstone 105 is adjusted between different positions. Referring now to FIGS. 12A–12C, the toggling mechanism 150 comprises a toggle block 152 and a compression spring 154 disposed between the toggle block 152 and a rearward interior wall 156 in the cartridge. The toggling mechanism 150 is configured for interaction with the mounting base 140 in a manner similar to the first embodiment. In particular, the bias force exerted by the spring 154 on the toggle block 152 and mounting base 140 urges the mounting base to rotate into a position in which the sides of the body portion 142 engage the interior of the cartridge 120. This may be one of three positions, which are illustrated in FIGS. 12A–12C. FIG. 12A shows the mounting stud 130 rotated into an upward facing orientation. FIG. 12B shows the mounting stud 130 rotated into a forward facing orientation. Lastly, FIG. 12C shows the mounting stud 130 rotated into a downward facing orientation. As in the first embodiment, the mounting base 140 is relatively unstable and does not remain in intermediate positions in which corner edges of the body portion 142 engage the toggle block 152.

The present invention is intended for use with any jewelry configuration, including but not limited to rings, pendants, brooches, bracelets and anklets. As discussed with the first and second embodiments, the toggling mechanism may cooperate with a mounting base to convert a jewelry piece 1 or 101 to a ring, a pendant or other jewelry configuration. Alternatively, the toggling mechanism may be used in a fixed configuration for displaying a decorative article in multiple orientations. Referring now to FIGS. 13A–16B, a third embodiment of the present invention is shown comprising a gem mount 210 on a ring 201. The gem mount 210 permits rotation of an article 204 about a generally vertical axis on the ring 201. The gem mount 210 comprises many of the same elements as those described for the first and second embodiments. For purposes of this description, elements in mount 210 that correspond to similar elements in the first embodiment are referenced with the same number plus two hundred.

Figure 13B:
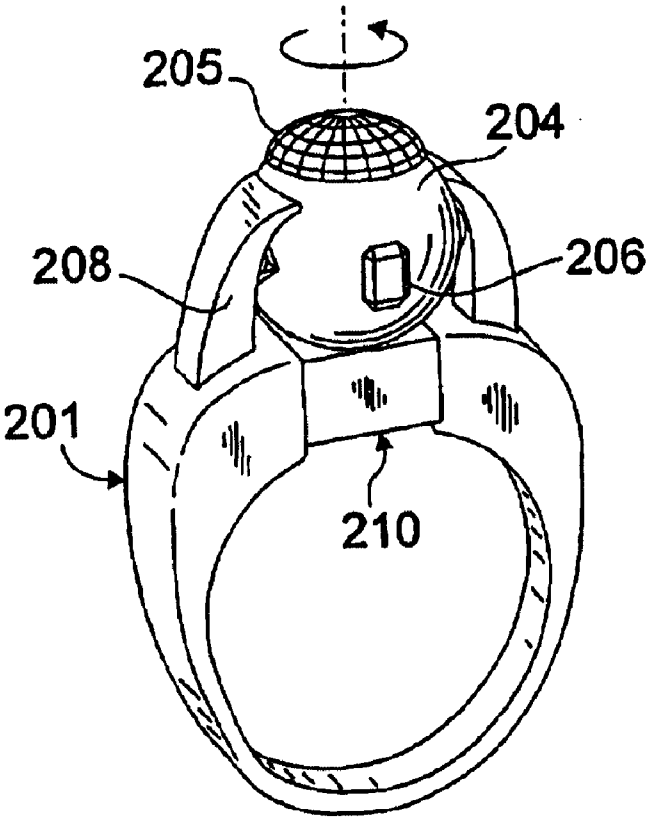
FIG. 13B is a perspective view of the jewelry piece in FIG. 13A, said jewelry mount adjusted to display a gemstone on a ring in a second orientation.
Figure 13A:
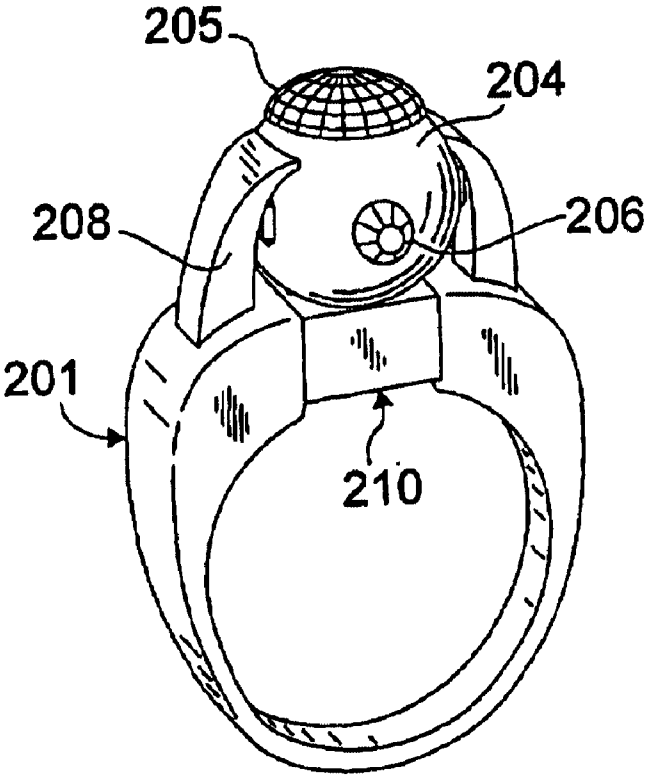
FIG. 13A is a perspective view of a jewelry piece having an adjustable jewelry mount in accordance with a third embodiment of the present invention, said jewelry mount adjusted to display a gemstone on a ring in a first orientation.

Referring now to FIGS. 13A and 13B, the article 204 is shown mounted on a ring 201. A pair of buttresses 208 extend upwardly and inwardly from the ring 201 and are configured to slidably engage the article 204. The article 204 has a single gemstone 205 on a top side of the article and a plurality of smaller gemstones 206 arranged around the periphery of the article. Mount 210 is configured to permit rotation of the article 204 horizontally such that the single gemstone 205 rotates in place on the top of the article and the peripheral gemstones 206 rotate about the periphery of the article. FIG. 13A shows the article 204 displayed in one orientation, and FIG. 13B shows the article rotated ninety degrees from the orientation in FIG. 13A.

Figure 15:
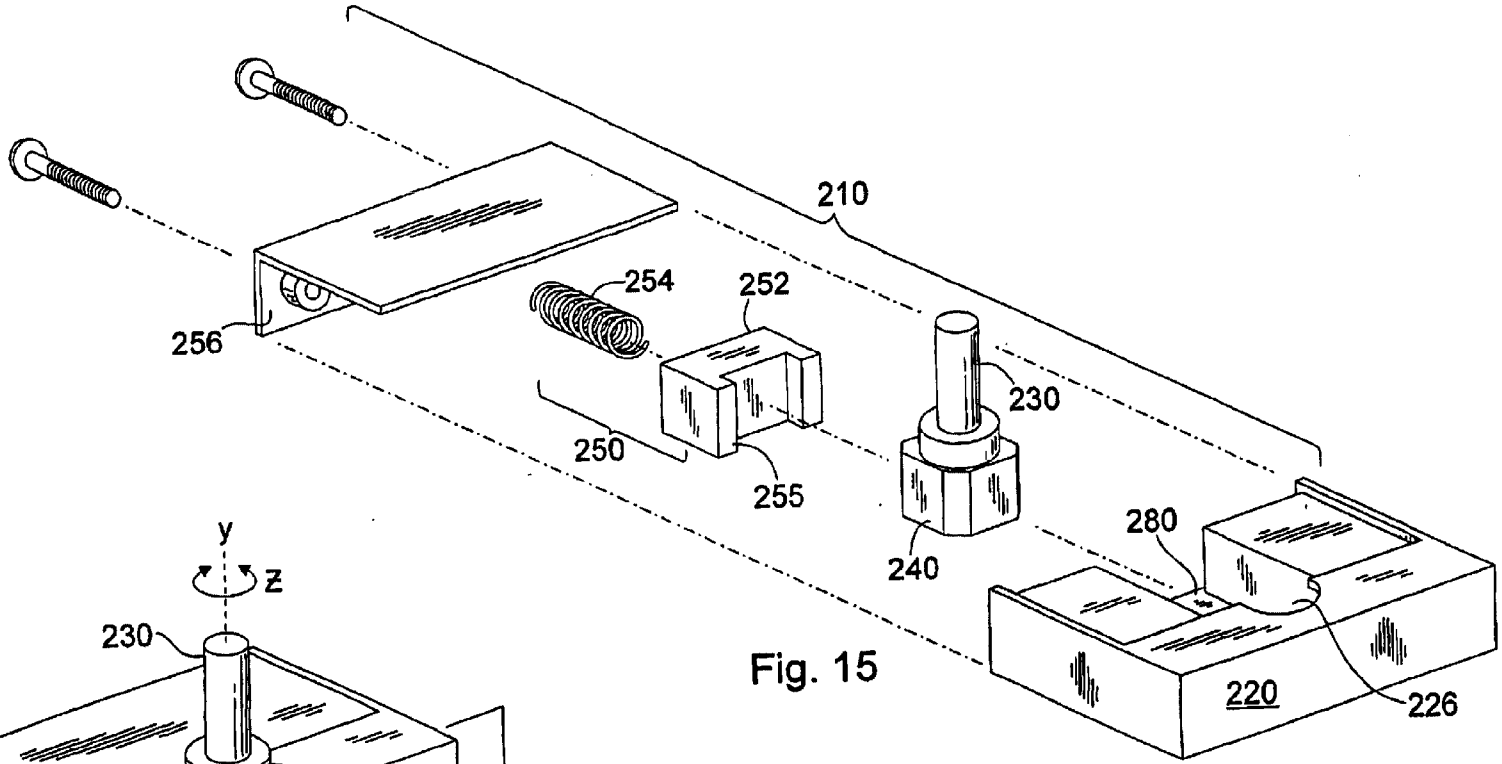
FIG. 15 is an exploded perspective view of the jewelry mount in FIG. 13A.
Figure 14:
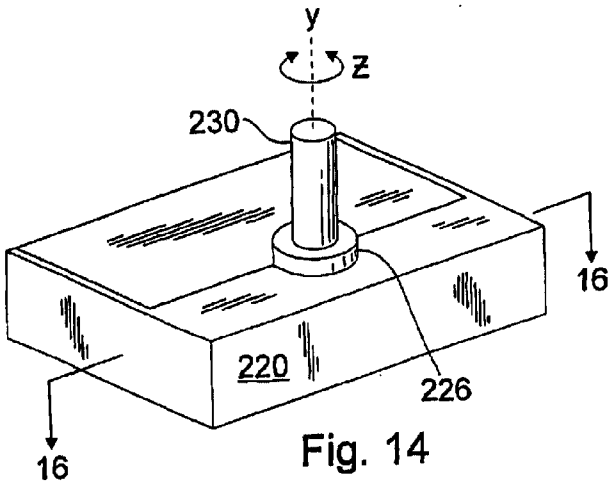
FIG. 14 is a perspective view of the jewelry mount as used in FIG. 13A showing a cartridge and a mounting stud configured for rotation about an axis through the mounting stud.

Referring now to FIGS. 14 and 15, the gem mount 210 comprises a generally rectangular cartridge 220 that may be incorporated into the body of a jewelry piece. Cartridge 220 is hollow and is configured to hold a mounting base 240 and a toggling mechanism 250. The mounting base 240 projects through an aperture 226 on a top face of the cartridge 220. A mounting stud 230 extends from the portion of the mounting base 240 which projects through the aperture 226, as shown in FIG. 14. The mounting stud 230 is configured to support and display a gemstone or other article 204 above the mount 210.

Unlike the first and second embodiments, the mounting stud 230 is maintained in an upward facing orientation relative to the cartridge 220. The mounting stud 230 and mounting base 240 are generally symmetrical about a longitudinal axis, which is represented by a dashed line and letter "y" in FIGS. 14. The mounting base 240 is disposed in a cavity 280 adapted to permit rotational displacement of the mounting base about the y-axis. The mounting base 240 and mounting stud 230 are configured to rotate about the y-axis in response to torque applied to an article mounted on the mounting stud. The components are configured for rotation in either a clockwise direction or a counterclockwise direction, as represented by the circular arrows labeled "Z" in FIG. 14.

Figure 16B:
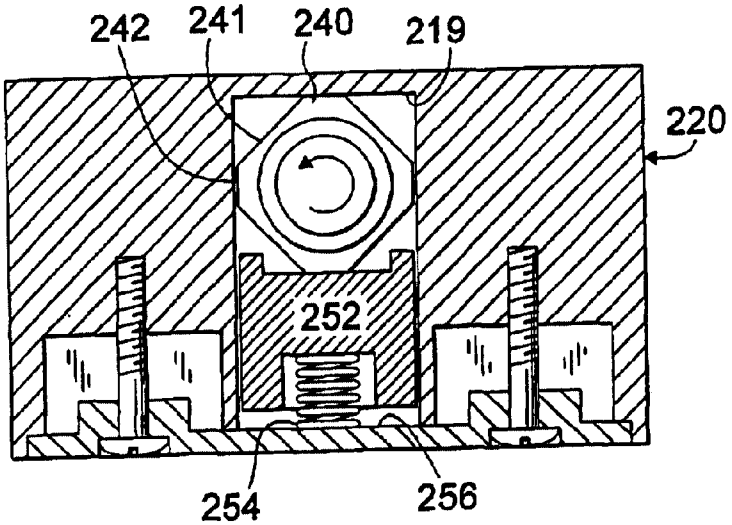
FIG. 16B is a cross-sectional view of the jewelry mount in FIG. 13A in a second position relative to a toggling mechanism.

Referring now to FIGS. 15–16B, the interaction of the toggling mechanism 250 and mounting base 240 will be described in greater detail. As in the previous embodiments, the toggling mechanism 250 comprises a toggle block 252 and a spring 254 compressed between the toggle block and a rearward interior wall 256 in the cartridge 220. The compressed spring 254 exerts a forward force on the toggle block 252 and maintains the toggle block in an abutting relationship with the mounting base 240. The toggle block 252 has a forward face 255 configured to slidably engage an edge on the mounting base 240 as the mounting base is rotated. The mounting base 240 is generally square with four sides 241 disposed ninety degrees apart from one another. The sides 241 are separated by corner edges 242 that engage the forward face 255 of the toggle block 252. The corner edges 242 may be sharp ninety degree corners. Alternatively, the corner edges may be chamfered or rounded to provide a relatively smooth transition as the mounting base 240 is rotated to different orientations. In FIGS. 15–16B, the corner edges 242 are shown chamfered.

Figure 16A:
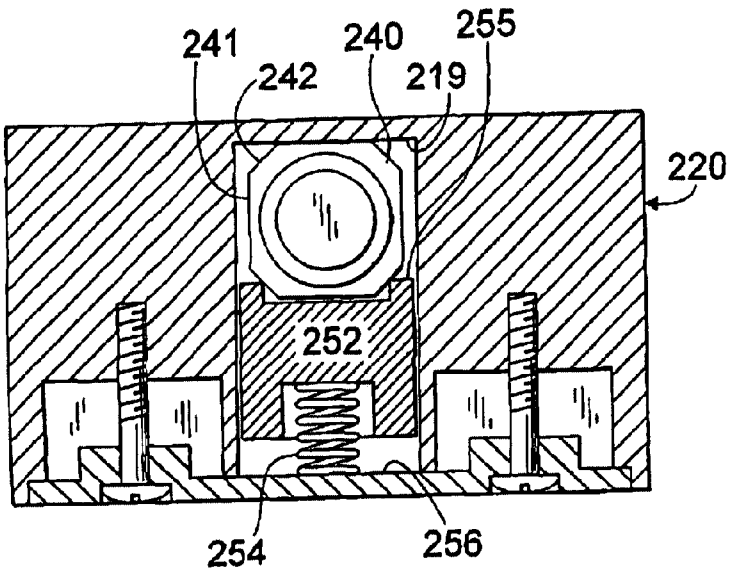
FIG. 16A is a cross-sectional view of the jewelry mount in FIG. 13A oriented in a first position relative to a toggling mechanism.

The mounting base 240 is operable to engage the toggle block 252 in a plurality of orientations so that the article 204 is adjustable into semi-fixed or set positions. In particular, the toggle block 252 is configured to engage the four sides 241 of the mounting base 240 such that the article 204 is rotatable into four set orientations. Once the article is rotated into one of the set orientations, the mounting stud 230 is retained against further rotation until a torque is applied to the article. When a side 241 is rotated toward the forward face 255 of the toggle block 252, the opposing side on the base 240 bears against an inner face 219 in the cartridge 220 in response to the bias force of the spring 254, as shown in FIG. 16A. The engagement of the mounting base 240 against the inner face 219 of the cartridge 220 stabilizes the position of the base and provides moderate resistance to further rotational displacement. This moderate resistance substantially limits rotational displacement that may result from gravitational pull, incidental bumps, or other minor forces that act on the jewelry piece. The resistance may be overcome, and the article 204 rotated out of the set orientation, only by applying a torque on the article or mounting stud 230.

The corner edges 242 of mounting base 240 are also configured to engage the toggle block 252 and interior surfaces of the cartridge 220. In particular, when a corner edge 242 is rotated toward the forward face 255 of the toggle block 252, the opposite corner edge 242 bears against the inner face 219 in the cartridge 220 in response to the bias force of the spring 254. Preferably, the mounting base 240 is configured so that the orientation of the base is relatively unstable and does not remain in an orientation where a corner edge 242 engages the toggle block 252. In particular, the corner edges 242 are preferably configured to slidably engage the toggle block 252 and inner face 219 with minimal frictional resistance. As shown in FIGS. 16A and 16B, the corner edges 242 have a significantly smaller width than the adjacent sides 241. Therefore, the area of engagement between the inner face 219 and a corner edge of the mounting base 240 is much smaller than the area of contact between the inner face and a side. The engagement between the corner edges and the inner face 219 provides a relatively low frictional resistance to further rotational displacement of the mounting base 240. As such, the orientation of the mounting base 240 is relatively unstable and does not remain in an orientation where a corner edge engages the toggle block.

An important aspect of the present invention is the commonality of components used in the three embodiments. In particular, the three embodiments operate similarly and use the same screws, cover plates, springs and toggle blocks. These components may be mass produced for assembly in all three embodiments of the invention. In addition, the cartridges in all three embodiments are formed from the same cartridge mold. Once the basic cartridge piece is formed, interior and exterior features on each cartridge piece may be cut or shaped to meet the particular specifications for a chosen embodiment. In particular, the slot, interior cavity, and exterior corners may be cut and shaped as necessary to meet the particular specifications of each individual embodiment. Furthermore, the mounting base and mounting stud elements are identical in both the first and second embodiments. Therefore, these components may be mass produced for assembly into the first and second embodiments of the invention.

In the foregoing descriptions, the present invention has been described as having a cartridge that can be inserted or assembled into a jewelry piece. The jewelry piece may have a channel configured to receive the cartridge. The cartridge may be secured within the channel using any suitable connection known in the art, such as soldering. The present invention is intended for use with a variety of jewelry pieces. In particular, the components of the present invention may be manufactured as part of a jewelry piece or retrofitted into an existing jewelry piece. Where the components are retrofitted into a jewelry piece, a channel may be cut into the jewelry piece to receive a cartridge.

One skilled in the art will appreciate that the present invention can be practiced with or without utilizing a cartridge component. In particular, a gem mount in accordance with the present invention may be produced by forming a receptacle in a jewelry piece that has the same interior features as those formed in the cartridge. The hollow receptacle may contain a slot and cavity similar to the slot 26 and cavity 28 shown in the cartridge 20 in FIGS. 6 and 7. The cavity in the hollow receptacle may be adapted to receive a mounting base, mounting stud, biasing mechanism and cover plate as shown and described with a cartridge.

The terms and expressions which have been employed are used as terms of description and not of limitation. There is no intention in the use of such terms and expressions of excluding any equivalents of the features shown and described or portions thereof. It is recognized, therefore, that various modifications are possible within the scope and spirit of the invention. For example, the jewelry ornamentations have been described herein as being gemstones. The present invention may also be used in jewelry pieces to display artificial stones, fraternity crests, school insignia, artifacts, commemorative items or any other object or design one wishes to display. Accordingly, the invention incorporates variations that fall within the scope of the following claims.

What is claimed is:

1. A device for mounting decorative components, commemorative components, and the like on a jewelry piece comprising a mounting stud configured for supporting a decorative component, commemorative component, or the like, and a generally rectangular mounting base connected to said stud, said rectangular mounting base being disposed in a generally rectangular cavity and held in an abutting relationship with a toggling mechanism in the cavity that permits rotation of said rectangular mounting base about a rotary axis within the cavity, said toggling mechanism engaging a leading edge on the mounting base which alternates between a side of the mounting base and a corner edge of the mounting base as the mounting base is rotated, said mounting stud being selectively adjustable between a plurality of positions to orient the decorative component commemorative component or the like in a plurality of orientations relative to the jewelry piece, wherein the toggling mechanism comprises a generally rectangular toggle block having a forward face urged into an abutting relationship with the leading edge on the mounting base by a biasing element disposed between the toggle block and an interior wall within the cavity, said toggle block being slidably displaceable within the cavity against the force of the biasing element as the toggle block engages the corner edge on the mounting base, such that said biasing element urges the toggle block into an abutting relationship with the side of the mounting base.

2. The device of claim 1, wherein the biasing element comprises a compression spring configured to impose a forward force against the toggle block to urge the toggle block into an abutting relationship with the mounting base, said toggle block being displaced against the force of the spring in a relatively unstable position as the toggle block engages the corner edge of the mounting base, and displaced by the force of the spring into a relatively stable position as the toggle block engages the side of the mounting base, such that the spring biases the mounting base into a position in which the side of the mounting base engages the toggle block.

3. The device of claim 1 wherein the mounting stud is adjustable into an upward facing orientation and a forward facing orientation.

4. The device of claim 1 wherein the mounting stud is adjustable into an upward facing orientation, a forward facing orientation and a downward facing orientation.

5. The device of claim 1 wherein the mounting stud is adjustable between four orientations about the same axis, said orientations being offset ninety degrees from one another.

6. The device of claim 5 wherein the mounting base comprises a plurality of corner edges that are chamfered such that the mounting base is octagonal.

7. A device for mounting decorative components, commemorative components, or the like on a jewelry piece comprising a generally rectangular cartridge configured for attachment to a jewelry piece and a mounting stud configured for supporting a decorative component, commemorative component, or the like, said mounting stud connected to a generally rectangular mounting base disposed in the cartridge and urged into an abutting relationship with a toggling mechanism in the cartridge that permits rotation of the mounting base within the cartridge, said toggling mechanism engaging a leading edge on the mounting base which alternates between a side of the mounting base and a corner edge of the mounting base as the mounting base is rotated, wherein the mounting stud is adjustable between a plurality of positions to orient a gemstone or decorative component in a plurality of orientations relative to the jewelry piece.

8. The device of claim 7 wherein the toggling mechanism comprises a generally rectangular toggle block having a forward face urged into an abutting relationship with the leading edge on the mounting base by a biasing element disposed between the toggle block and an interior wall within the cartridge.

9. The device of claim 8 wherein the biasing element comprises a compression spring configured to impose a forward force against the toggle block to urge the toggle block into an abutting relationship with the mounting base, said toggle block being displaced against the force of the spring in a relatively unstable position as the toggle block engages the corner edge of the mounting base, and displaced by the force of the spring into a relatively stable position as the toggle block engages the side of the mounting base, such that the spring biases the mounting base into a position in which the side of the mounting base engages the toggle block.

10. The device of claim 7 wherein the mounting stud is adjustable into an upward facing orientation and a forward facing orientation.

11. The device of claim 7 wherein the mounting stud is adjustable into an upward facing orientation, a forward facing orientation and a downward facing orientation.

12. The device of claim 7 wherein the mounting stud is adjustable between four orientations about the same axis, said orientations being offset ninety degrees from one another.

13. The device of claim 12 wherein the mounting base comprises a plurality of corner edges that are chamfered such that the mounting base is octagonal.

14. A jewelry piece comprising a generally hollow cavity and a generally rectangular mounting base housed in the cavity, said mounting base connected to a mounting stud for supporting a decorative component, commemorative component or the like, wherein the mounting base is contained in the cavity in an abutting relationship with a toggling mechanism in the cavity that permits rotation of the mounting base within the cavity, said toggling mechanism engaging a leading edge on the mounting base which alternates between a side of the mounting base and a corner edge on the mounting base as the mounting base rotates, wherein the mounting stud is adjustable between a plurality of positions to orient the decorative component, commemorative component or the like in a plurality of orientations relative to the jewelry piece.

15. The device of claim 14 wherein the toggling mechanism comprises a generally rectangular toggle block having a forward face urged into an abutting relationship with the leading edge on the mounting base by a biasing element disposed between the toggle block and an interior wall within the cavity, said toggle block being slidably displaceable within the cavity.

16. The device of claim 15 wherein the biasing element comprises a compression spring configured to impose a forward force against the toggle block to urge the toggle block into an abutting relationship with the mounting base, said toggle block being displaced against the force of the spring in a relatively unstable position as the toggle block engages the corner edge of the mounting base, and displaced by the force of the spring into a relatively stable position as the toggle block engages the side of the mounting base, such that the spring biases the mounting base into a position in which the side of the mounting base engages the toggle block.

17. The device of claim 14 wherein the mounting stud is adjustable into an upward facing orientation and a forward facing orientation.

18. The device of claim 14 wherein the mounting stud is adjustable into an upward facing orientation, a forward facing, orientation and a downward facing orientation.

19. The device of claim 14 wherein the mounting stud is adjustable between four orientations about the same axis, said orientations being offset ninety degrees from one another.

20. The device of claim 19 wherein the mounting base comprises a plurality of corner edges that are chamfered such that the mounting base is octagonal.

* * * * *